US008887507B2

(12) United States Patent
Davis, Jr. et al.

(10) Patent No.: US 8,887,507 B2
(45) Date of Patent: Nov. 18, 2014

(54) TRAVERSING FUEL NOZZLES IN CAP-LESS COMBUSTOR ASSEMBLY

(75) Inventors: Lewis Berkley Davis, Jr., Niskayuna, NY (US); Joseph Vincent Citeno, Greenville, SC (US); Thomas Edward Johnson, Greer, SC (US); Willy Steve Ziminsky, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 187 days.

(21) Appl. No.: 13/449,904

(22) Filed: Apr. 18, 2012

(65) Prior Publication Data

US 2012/0198851 A1 Aug. 9, 2012

Related U.S. Application Data

(63) Continuation of application No. 12/352,674, filed on Jan. 13, 2009, now abandoned.

(51) Int. Cl.
*F23R 3/30* (2006.01)
*F23R 3/28* (2006.01)

(52) U.S. Cl.
CPC ..... *F23R 3/286* (2013.01)
USPC ..... 60/737; 60/738; 60/747

(58) Field of Classification Search
CPC ..... F23R 3/28; F23R 3/283; F23R 3/286; F23R 3/30; F23R 3/32; F23R 3/34; F23R 3/343; F23R 3/346
USPC ..... 60/738, 740, 742, 747, 748, 800, 734, 60/737, 741, 746
See application file for complete search history.

(56) References Cited

U.S. PATENT DOCUMENTS

| | | | | | |
|---|---|---|---|---|---|
| 1,679,830 | A | * | 8/1928 | Lang | 431/186 |
| 1,786,946 | A | * | 12/1930 | Hofmann | 60/741 |
| 2,655,787 | A | * | 10/1953 | Brown | 60/39.23 |
| 3,095,153 | A | * | 6/1963 | Soth | 239/405 |
| 3,728,859 | A | * | 4/1973 | Seiler | 60/39.49 |
| 3,741,166 | A | * | 6/1973 | Bailey | 122/23 |

(Continued)

FOREIGN PATENT DOCUMENTS

| | | |
|---|---|---|
| CN | 1673620 A | 9/2005 |
| EP | 1225392 A2 | 7/2002 |

(Continued)

OTHER PUBLICATIONS

Unofficial English translation of Office Action issued in connection with corresponding JP Application No. 2010-002463 on Oct. 15, 2013.

(Continued)

*Primary Examiner* — Gerald L Sung
*Assistant Examiner* — Michael B Mantyla
(74) *Attorney, Agent, or Firm* — Cantor Colburn LLP

(57) ABSTRACT

A combustor includes a central fuel nozzle assembly and a plurality of outer fuel nozzle assemblies, each of the plurality of outer fuel nozzle assemblies having a center body and an outer shroud, the plurality of outer fuel nozzle assemblies being configured to abut one another in a surrounding relationship to the central cylinder such that no gaps are present between any two abutting ones of the plurality of outer fuel nozzle assemblies. One or more of the plurality of fuel nozzle assemblies may traverse axially back and forth according to embodiments of the invention.

13 Claims, 4 Drawing Sheets

(56) References Cited

U.S. PATENT DOCUMENTS

| | | | | | |
|---|---|---|---|---|---|
| 3,788,797 | A | * | 1/1974 | Mayfield et al. | 431/186 |
| 3,974,646 | A | * | 8/1976 | Markowski et al. | 60/737 |
| 4,078,377 | A | * | 3/1978 | Owens et al. | 60/39.23 |
| H19 | H | * | 2/1986 | Carlson | 431/12 |
| 5,125,227 | A | * | 6/1992 | Ford et al. | 60/39.23 |
| 5,257,499 | A | * | 11/1993 | Leonard | 60/39.23 |
| 5,319,923 | A | * | 6/1994 | Leonard et al. | 60/39.23 |
| 5,323,604 | A | | 6/1994 | Ekstedt et al. | |
| 5,343,693 | A | | 9/1994 | Komatsu et al. | |
| 5,373,693 | A | * | 12/1994 | Zarzalis et al. | 60/39.23 |
| 5,664,412 | A | * | 9/1997 | Overton | 60/39.23 |
| 6,026,645 | A | * | 2/2000 | Stokes et al. | 60/737 |
| 6,038,861 | A | | 3/2000 | Amos et al. | |
| 6,082,111 | A | * | 7/2000 | Stokes | 60/737 |
| 6,101,814 | A | | 8/2000 | Hoke et al. | |
| 6,122,916 | A | * | 9/2000 | Amos et al. | 60/747 |
| 6,199,367 | B1 | | 3/2001 | Howell | |
| 6,272,842 | B1 | * | 8/2001 | Dean | 60/39.23 |
| 6,282,886 | B1 | | 9/2001 | Sato et al. | |
| 6,427,446 | B1 | * | 8/2002 | Kraft et al. | 60/737 |
| 6,453,660 | B1 | | 9/2002 | Johnson et al. | |
| 6,701,713 | B2 | * | 3/2004 | Mandai et al. | 60/737 |
| 6,742,338 | B2 | * | 6/2004 | Tanaka et al. | 60/737 |
| 6,772,594 | B2 | * | 8/2004 | Nishida et al. | 60/737 |
| 6,915,637 | B2 | * | 7/2005 | Nishida et al. | 60/737 |
| 6,968,692 | B2 | * | 11/2005 | Chin et al. | 60/737 |
| 7,360,363 | B2 | * | 4/2008 | Mandai et al. | 60/737 |
| 7,370,466 | B2 | * | 5/2008 | Cai | 60/39.11 |
| 7,581,402 | B2 | * | 9/2009 | Parker | 60/798 |
| 7,891,191 | B2 | * | 2/2011 | Yoshida et al. | 60/740 |
| 8,069,671 | B2 | * | 12/2011 | Hellat et al. | 60/776 |
| 8,113,000 | B2 | * | 2/2012 | Laster et al. | 60/737 |
| 2005/0211142 | A1 | | 9/2005 | Yamamoto et al. | |
| 2007/0125085 | A1 | | 6/2007 | Commaret et al. | |
| 2008/0289341 | A1 | | 11/2008 | Ishizaka et al. | |
| 2010/0101229 | A1 | | 4/2010 | York et al. | |

FOREIGN PATENT DOCUMENTS

| | | | |
|---|---|---|---|
| JP | 0518537 | A | 1/1993 |
| JP | 0579629 | A | 3/1993 |
| JP | 07318059 | A | 12/1995 |
| JP | 08178287 | A | 7/1996 |
| JP | 2000146183 | A | 5/2000 |
| JP | 2004226051 | A | 8/2004 |
| JP | 2006336995 | A | 12/2006 |

OTHER PUBLICATIONS

Search Report from CN Application No. 201010005233.2 dated May 26, 2013.

* cited by examiner

TRAVERSING FUEL NOZZLES IN CAP-LESS COMBUSTOR ASSEMBLY

CROSS REFERENCE TO RELATED APPLICATIONS

This application is a continuation of U.S. application Ser. No. 12/352,674 filed on Jan. 13, 2009.

BACKGROUND OF THE INVENTION

Premixed Dry Low NOx (DLN) combustion systems for heavy-duty gas turbines for both annular and can-annular designs are based on fuel staging, air staging, or a combination of the two. This enables operation across a relatively wide range of conditions. The window for premixed combustion is relatively narrow when compared to the duty cycle of a modern gas turbine. Thus, conditions within the combustion system are typically "staged" to create local zones of stable combustion despite the fact that bulk conditions may place the design outside its operational limits (i.e., emissions, flammability, etc.).

Additionally, staging affords an opportunity to "tune" the combustion system away from potentially damaging acoustic instabilities. Premixed systems may experience combustion "dynamics". The ability to change the flame shape, provide damping, or stagger the convective time of the fuel to the flame front have all been employed as a means to attempt to control the onset of these events. However, these features tend to be either non-adjustable or can only be exercised at the expense of another fundamental boundary such as emissions.

Dynamics mitigation is a source of continuous investigation. Most combustor designs have a means of staging the fuel flow (commonly referred to as a "fuel split") but this creates an emissions penalty. Other designs have multiple fuel injection planes to create a mixture of convective times. Again, here numerous approaches are possible, such as fuel forcing, resonators, quarter wave tubes, etc.

Acoustic instabilities are an indication of a coincidence of heat release fluctuations with one or more of the inherent acoustic modes of the combustion chamber. The manner in which these heat release fluctuations interact with the chamber is dictated to a large extent by the shape of the flame and the transport time of the fuel/air mixture to the flame front. Both parameters are commonly manipulated by changing the distribution of the fuel to the various nozzles within the combustor. If the nozzles are in a common axial plane, then the main effect is to change the flame shape. If instead the nozzles are in distinct axial locations, then the main effect is to change the convective times. Additionally, nozzles in a common plane may result in detrimental nozzle-to-nozzle flame front interactions unless one nozzle is "biased" to prevail from a stability standpoint over the adjacent nozzles. However, either adjustment leads to a reduction in operability. That is, non-uniform fuel distribution in a common plane leads to relatively higher NOx emissions through the well-established exponential dependency of NOx formation on local flame temperature. Also, non-uniform fuel distribution in distinct axial locations can create a potential flame holding location if one nozzle group is upstream of the other (e.g., the "quat" system).

BRIEF DESCRIPTION OF THE INVENTION

According to one aspect of the invention, a combustor includes a fuel nozzle assembly that has a center body, an inner shroud that surrounds at least a portion of the center body, an outer shroud that surrounds at least a portion of the inner shroud, and a plurality of cooling holes formed in a portion of the outer shroud, cooling air being introduced in a space between the inner and outer shrouds and exiting from the plurality of cooling holes. The combustor also includes an actuator that moves at least the center body in an axial direction.

According to another aspect of the invention, a combustor includes at least one fuel nozzle assembly having a center body, a shroud that surrounds at least a portion of the center body, and a vane disposed between the center body and the shroud. The combustor also includes an actuator that moves at least the center body in an axial direction.

According to yet another aspect of the invention, a combustor includes a central fuel nozzle assembly and a plurality of outer fuel nozzle assemblies, each of the plurality of outer fuel nozzle assemblies having a center body and an outer shroud, the plurality of outer fuel nozzle assemblies being configured to abut one another in a surrounding relationship to the central cylinder such that no gaps are present between any two abutting ones of the plurality of outer fuel nozzle assemblies.

These and other advantages and features will become more apparent from the following description taken in conjunction with the drawings.

BRIEF DESCRIPTION OF THE DRAWING

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION

Figure 1:
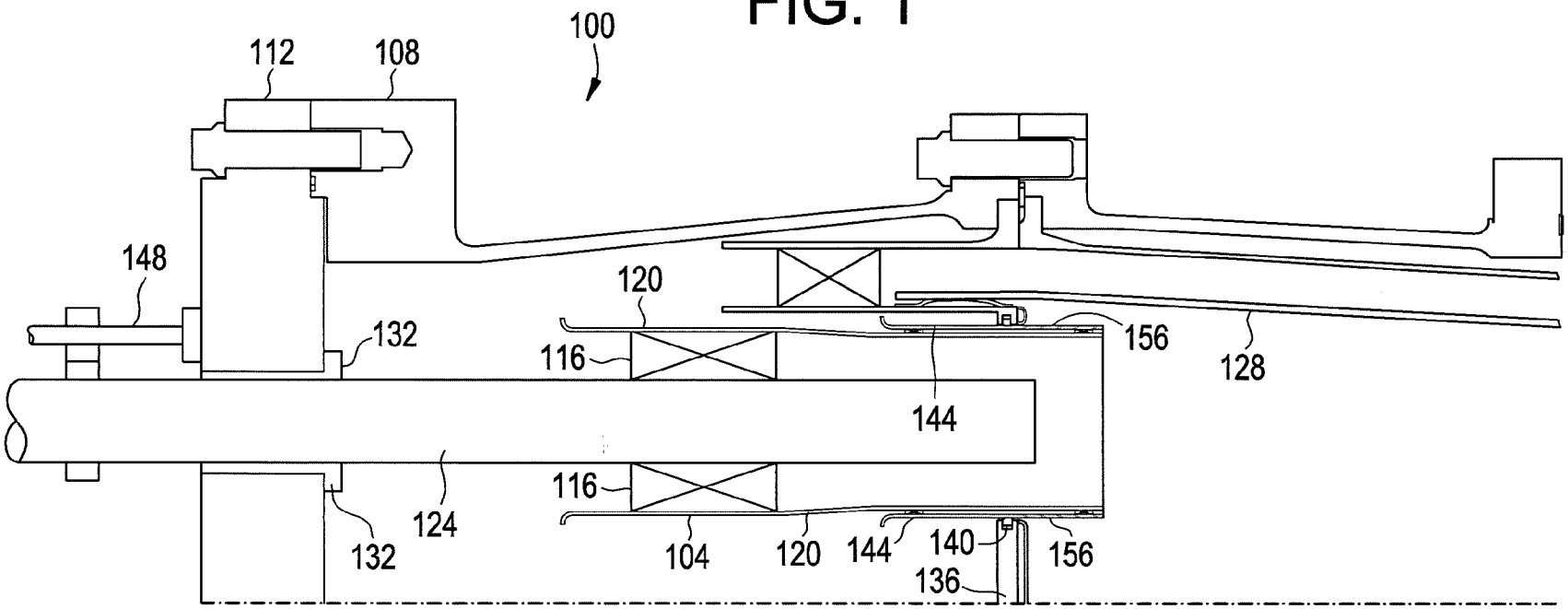
FIG. 1 is a cross section view of a combustor having a traversing fuel nozzle assembly according to an embodiment of the invention.
Figure 2:
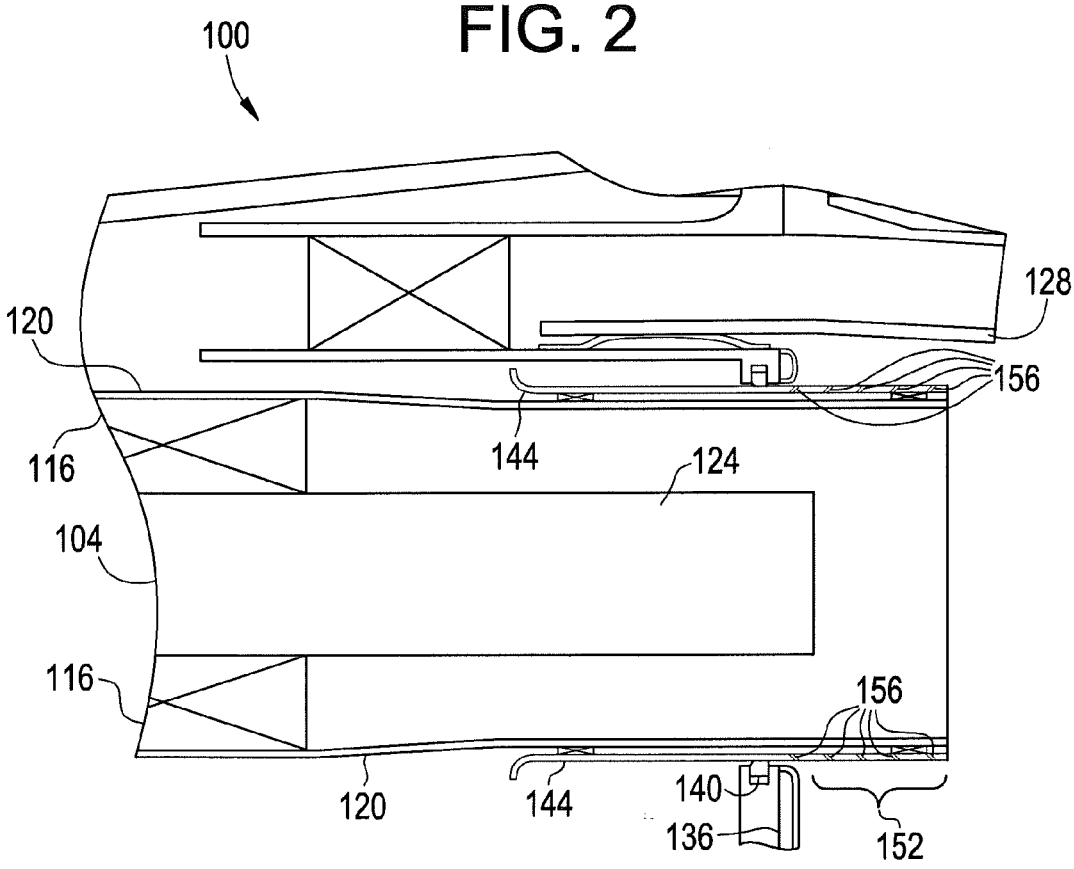
FIG. 2 is a more detailed cross section view of the combustor with the traversing fuel nozzle assembly of FIG. 1.

Referring to FIGS. 1 and 2, a combustor 100 for a gas turbine includes a plurality of fuel nozzle assemblies 104, one of which is shown in the embodiment of FIGS. 1 and 2. One or more of the plurality of fuel nozzle assemblies 104 may traverse axially back and forth according to embodiments of the invention. As shown in FIG. 1, the combustor 100 also includes a combustor case 108 and an end cover 112. Each of the fuel nozzle assemblies 104 may include a vane 116, an inner shroud 120, a center body 124, a liner 128, a seal assembly 132, a bulkhead/cap assembly 136, a seal 140, an outer shroud 144, and an actuator mechanism 148.

In accordance with one embodiment of the invention, the entire fuel nozzle assembly 104 may be moved or traversed axially. In accordance with another embodiment, only the center body 124 of the fuel nozzle assembly 104 may be moved axially. In addition, only one of the fuel nozzle assemblies 104 may be moved axially at any one time, or some combination of two or more of the fuel nozzle assemblies 104 may be moved axially at any one time. Movement of a portion or all of one or more of the fuel nozzle assemblies 104 is typically carried out to tune the performance of the combustor 100 as desired. Regardless of the type of movement of the fuel nozzle assemblies 104, such movement is achieved by one or more of the actuator mechanisms 148. The actuator mechanism 148 may comprise any type of suitable actuator, such as electric, hydraulic, pneumatic, etc., that is controlled by a controller (not shown). The output of the actuator mechanism 148 connects by suitable mechanical linkages to the center body 124 of the corresponding fuel nozzle assembly 104. The actuator mechanism 148 is operable to move only the center body 124 or, where desired, may move the fuel nozzle assembly 104 that includes not only the center body 124 but also the vane 116 and the inner and outer shrouds 120, 144. Such movement is in an axial direction (i.e., back and forth in FIGS. 1 and 2). Each fuel nozzle assembly 104 may have a dedicated actuator mechanism 148, or one or more fuel nozzle assemblies may be "ganged" or connected together and moved in unison by a single actuator mechanism 148.

This type of movement sets the depth of emersion of the center body 124 into a combustion "hot zone", which is that portion of the combustor 100 to the right of the bulkhead/cap assembly 136 as viewed in FIGS. 1 and 2. The "emersion zone" is indicated in FIG. 2 by the reference number 152. As can be seen from FIGS. 1 and 2, the center body 124 of the fuel nozzle assembly shown there protrudes somewhat past (i.e., to the right of) the bulkhead/cap assembly 136 and into the combustion "hot zone". Typical temperatures in this "hot zone" may be approximately 3000 degrees Fahrenheit. As a result, it is necessary to cool the inner shroud 120, which also protrudes past the bulkhead/cap assembly 136 and into the combustion "hot zone". In the embodiment of FIGS. 1 and 2, the inner and outer shrouds 120, 144 are configured to go beyond the right end of the center body 124 as viewed in these figures. However, an alternative embodiment may have the right end of the center body 124 be even with the ends of the inner and outer shrouds 120, 144.

This type of cooling of the inner shroud 120 may be achieved by forming a number of cooling holes 156 in the outer shroud 144 and forcing relatively cooler air in the space between the inner and outer shrouds 120, 144 from the left side in FIGS. 1 and 2. The cooling air then exits through the cooling holes 156 in the outer shroud 144. This type of film cooling is suitable to cool the inner shroud 120 and prevent its destruction by melting in the combustion "hot zone".

Figure 3:
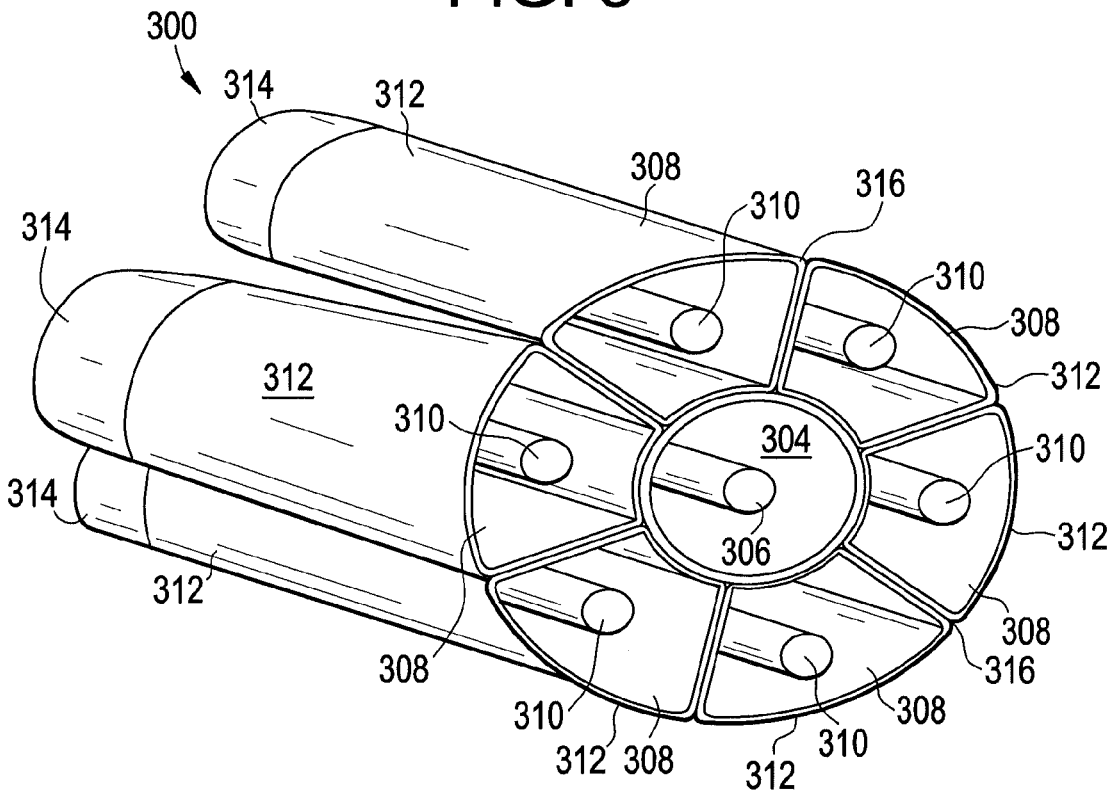
FIG. 3 is a perspective view of a combustor having a plurality of traversing fuel nozzles according to another embodiment of the invention.

In the fuel nozzle assemblies 104 illustrated in FIGS. 1 and 2, the shrouds 120, 144 may have a round or circular cross section when viewed at their exit (i.e., as viewed from right to left in FIGS. 1 and 2). As such, this necessitates the use of a cap as part of the bulkhead/cap assembly 136. The cap is typically a relatively thin cooled plate that fills in the spaces between the circular cross section fuel nozzle assemblies 104, thus isolating the zone of heat release from the upstream components. Referring to FIG. 3, there illustrated is an embodiment of a combustor 300 of the invention in which the nozzles 304, 308 are shaped to completely fill in any inter-nozzle gaps (i.e., "closely packed nozzles"). As such, this embodiment eliminates the need for the combustion cap as part of the bulkhead/cap assembly 136 of FIGS. 1 and 2 (i.e., a "cap-less combustor assembly"), which removes a recurring reliability issue for the thin cooled plate. In FIG. 3, a center fuel nozzle assembly 304 may be of circular or cylindrical shape and may contain a centrally located fuel nozzle 306.

The center fuel nozzle assembly 304 may be completely surrounded by a plurality (e.g., six) of the outer fuel nozzle assemblies 308. Each outer fuel nozzle assembly 308 may have a center body 310 and a trapezoidal shaped double walled cooled shroud 312. However, a trapezoidal shape for the shrouds 312 is purely exemplary; other shapes may be used so long as when the outer fuel nozzle assemblies 308 are placed near or adjacent one another there are no gaps between such assemblies 308 and no cap is needed to cover any gaps between such assemblies 308. The back end 314 of each outer fuel nozzle assembly 308 may have a circular shaped vane or swirler. Also, a compliant seal 316 may be provided at each junction between adjacent outer fuel nozzle assemblies 308, or between the center fuel nozzle assembly 304 and any one or more of the outer fuel nozzle assemblies 308, to eliminate any gaps therebetween. In this embodiment, the center body 310 and the vane 314 of the outer fuel nozzle assemblies 308, along with the center body 306 and vane 314 of the center fuel nozzle assembly, are moved in an axial back and forth direction. The plurality of fuel nozzle assemblies 304, 308 may be moved in an axial direction by the actuator mechanism 148 of FIG. 1. That is, the configuration of fuel nozzle assemblies 304, 308 illustrated in FIG. 3 may replace the circular or cylindrical fuel nozzle assemblies 104 in the embodiments of FIGS. 1 and 2 or the embodiment of FIG. 4 described hereinafter. As in the embodiments of FIGS. 1 and 2, a certain one or more of the fuel nozzle assemblies 304, 308 may be moved as desired to tune the combustor performance.

Figure 4:
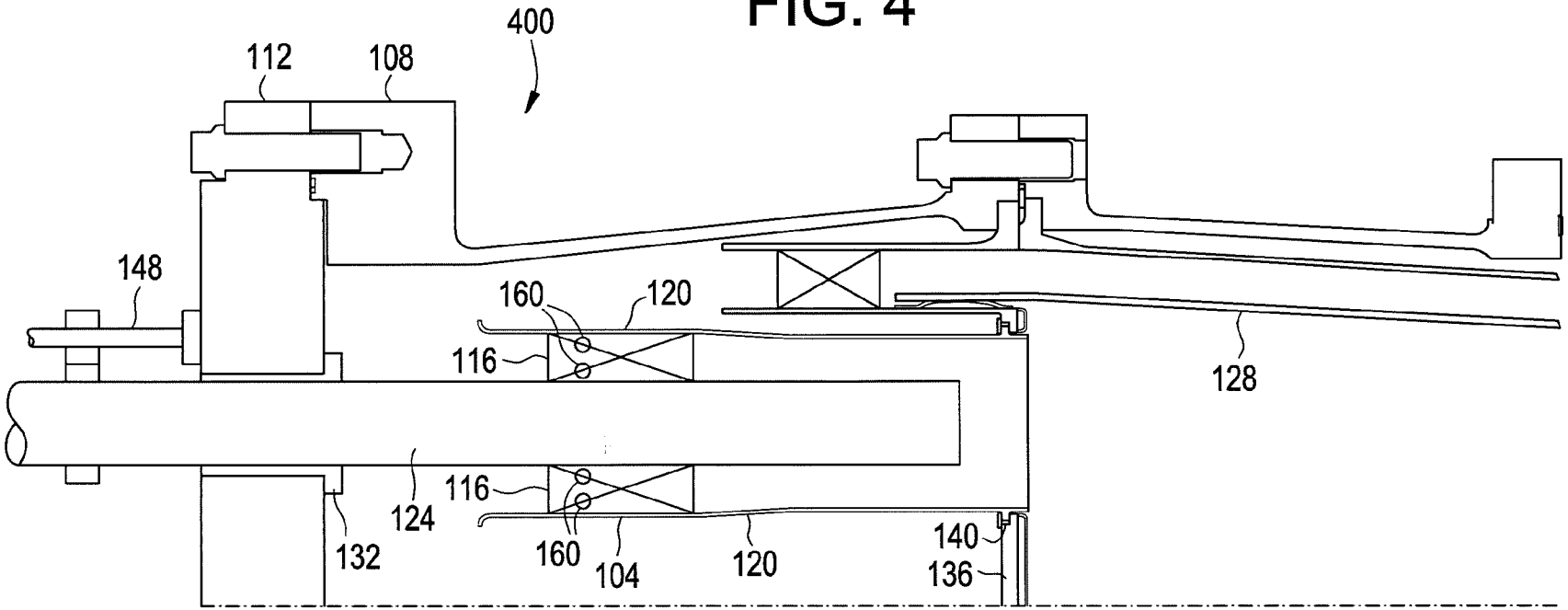
FIG. 4 is a cross section view of a combustor having a traversing fuel nozzle assembly according to yet another embodiment of the invention.

Referring to FIG. 4, a combustor 400 according to another embodiment of the invention is somewhat similar to the combustor 100 of the embodiment of FIGS. 1 and 2. Like reference numerals in FIG. 4 are used to denote like components in FIGS. 1 and 2. In the embodiment of FIG. 4, only the center body 124 and the vane 116 are moved or traversed axially in a back and forth direction by the actuator mechanism 148. A pair of fuel feed holes 160 is shown in the vane 116. The inner shroud 120 is fixed or attached to the bulkhead 136, which prevents any movement of the inner shroud 120. As such, there is no need for the outer shroud 144 of FIGS. 1 and 2 along with the cooling holes 156. This is due to the fact that the inner shroud 120 does not enter the "hot zone", thereby eliminating the need for any cooling of the inner shroud 120, in contrast to the embodiment of FIGS. 1 and 2.

Embodiments of the invention provide for an adjustable feature to target flame shape and convective times by allowing for the axial displacement of certain one or more of the fuel nozzle assemblies within the combustion chamber. By allowing for one or more fuel nozzle assemblies to traverse axially within the combustion chamber, both flame shape and convective time are affected without impacting NOx emissions or operability. More specifically, axial displacement of the nozzles changes the flame shape and the convective times to the flame front, thus affecting two of the most fundamental dynamics drivers in the combustor of a gas turbine. Also, the axial displacement of the nozzles can be leveraged to achieve improved (greater) turndown by delaying the quenching effect that under-fueled neighboring nozzles have on the "anchor" nozzles (i.e., preventing premature quenching of the anchor nozzles).

In addition, embodiments of the invention eliminate the need for a combustion "cap", which is a relatively thin cooled plate that fills in the space between the nozzles 104, thus isolating the zone of heat release from the upstream components. Instead, embodiments of the invention shape the nozzles to completely fill in the inter-nozzle gaps, resulting in "closely packed nozzles". The elimination of the combustion cap (i.e., a "cap-less combustor assembly") removes a recurring reliability issue for the thin cooled plate.

Further, each fuel nozzle assembly 104 has a burner tube or shroud that is cooled to allow the nozzle to protrude into the combustion "hot zone" of the combustion chamber. Cooling the nozzle burner tubes to allow the tubes to protrude into the "hot zone" is synergistic with the flame holding tolerant concepts (i.e. nozzles that can withstand flame holding long enough to detect and correct the event). Thus, cooling of nozzle burner tubes fits into the growing demand for fuel flexible designs.

Therefore, embodiments of the invention provide for a dynamics "knob" that does not impact emissions or flame holding and is synergistic with fuel flexibility improvements as well as increased turndown effects.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An actuator system, comprising:

a plurality of outer fuel nozzle assemblies of a gas turbine engine abutting one another in a surrounding relationship to a central fuel nozzle assembly;

the plurality of outer fuel nozzle assemblies each including a center body and a shroud disposed about the center body;

at least one of the plurality of outer fuel nozzle assemblies comprising an actuator mechanism configured to actively effect axial movement of the respective center body while leaving the respective shroud fixed, the actuator mechanism and the fuel nozzle assembly being arranged to maintain a constant cross-section between the centerbody and the shroud at a point along the shroud, which exhibits a constant mass flow rate of air flowing between the centerbody and the shroud at the point, during the axial movement;

a controller configured to control operation of the actuator mechanism, wherein the actuator mechanism connects to the respective center body by mechanical linkages.

2. The actuator system according to claim 1, wherein a plurality of the actuator mechanisms is each connected to respective one of the plurality of the outer fuel nozzle assemblies and the controller controls each actuator mechanism of the plurality of actuator mechanisms to effect axial movement of the center body of the respective outer fuel nozzle assembly independently of other actuator mechanisms of the plurality of actuator mechanisms.

3. The actuator system according to claim 1, wherein the actuator mechanism is connected to a plurality of the outer fuel nozzle assemblies and the controller controls the actuator mechanism to effect axial movement of each center body of the plurality of the outer fuel nozzle assemblies in unison.

4. The actuator system according to claim 1, further comprising a vane disposed between the respective shroud and the respective center body, wherein the actuator mechanism effects axial movement of the respective center body and the vane together.

5. The actuator system according to claim 1, wherein the plurality of outer fuel nozzle assemblies including a compliant seal between any two of the plurality of outer fuel nozzle assemblies, and between the central fuel nozzle assembly and any of the plurality of outer fuel nozzle assemblies, and the actuator mechanism effects axial movement of the center body of each of the plurality of the outer fuel nozzle assemblies and a centerbody of the central fuel nozzle assembly in unison.

6. The actuator system according to claim 1, wherein the plurality of outer fuel nozzle assemblies including a compliant seal between any two of the plurality of outer fuel nozzle assemblies, and between the central fuel nozzle assembly and any of the plurality of outer fuel nozzle assemblies, and the actuator mechanism effects axial movement of a center body of the central fuel nozzle assembly.

7. A combustor, comprising:

a plurality of outer fuel nozzle assemblies of a gas turbine engine abutting one another in a surrounding relationship to a central fuel nozzle assembly;

the plurality of outer fuel nozzle assemblies each including a center body and a shroud disposed about the center body;

at least one of the plurality of outer fuel nozzle assemblies comprising an actuator mechanism configured to actively effect axial movement of the respective center body while leaving the respective shroud fixed, the actuator mechanism and the at least one of the plurality of outer fuel nozzle assemblies being arranged to maintain a constant cross-section between the respective centerbody and shroud at a point along the shroud, which exhibits a constant mass flow rate of air flowing between the respective center body and shroud at the point during the axial movement, a controller configured to control operation of the actuator mechanism wherein the actuator mechanism connects to the respective center body by mechanical linkages.

8. The combustor according to claim 7, wherein the actuator mechanism is connected to at least one of the plurality of outer fuel nozzle assemblies and at least a centerbody of another one of the plurality of outer fuel nozzle assemblies is fixed.

9. The combustor according to claim 8, wherein the plurality of outer fuel nozzle assemblies including a compliant seal between any two of the plurality of outer fuel nozzle assemblies, and between the central fuel nozzle assembly and any one of the plurality of outer fuel nozzle assemblies.

10. The combustor according to claim 7, wherein a plurality of the actuator mechanisms is each connected to a respective one of the plurality of outer fuel nozzle assemblies, and the controller independently controls each of the plurality of the actuator mechanisms.

11. The combustor according to claim 7, wherein the actuator mechanism is connected to each of the plurality of outer fuel nozzle assemblies and actuates the plurality of outer fuel nozzle assemblies in unison.

12. The combustor according to claim 7, wherein each center body of each of the plurality of outer fuel nozzle assemblies includes a corresponding vane, and each center body and corresponding vane are arranged to be actuated together.

13. The combustor according to claim 12, wherein the respective shroud of each of the plurality of outer fuel nozzle assemblies surrounds at least a portion of a central shroud concentrically about the central fuel nozzle assembly, and the central shroud and the shroud for each of the plurality of outer fuel nozzle assemblies are fixed.

* * * * *